US006196043B1

(12) United States Patent
Ehardt

(10) Patent No.: US 6,196,043 B1
(45) Date of Patent: Mar. 6, 2001

(54) DOUBLE VEE LOCKBEAD FOR SHEET METAL FORMING

(75) Inventor: Joseph T. Ehardt, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/389,636

(22) Filed: Aug. 27, 1999

(51) Int. Cl.[7] ..... B21D 24/04
(52) U.S. Cl. ..... 72/350
(58) Field of Search ..... 72/350, 351, 358, 72/359

(56) References Cited

U.S. PATENT DOCUMENTS

| | | | | |
|---|---|---|---|---|
| 2,285,903 | | 6/1942 | Clark | 113/46 |
| 3,299,689 | * | 1/1967 | Dolney et al. | 72/350 |
| 3,664,172 | | 5/1972 | Cyacho | 72/350 |
| 3,789,649 | | 2/1974 | Clowes | 72/350 |
| 4,833,903 | | 5/1989 | de Smet | 72/57 |
| 5,372,026 | | 12/1994 | Roper | 72/60 |
| 5,572,896 | | 11/1996 | Story | 72/350 |
| 5,644,943 | | 7/1997 | Lanz | 72/348 |
| 5,701,777 | | 12/1997 | Yamanaka et al. . | |

FOREIGN PATENT DOCUMENTS

| | | | | |
|---|---|---|---|---|
| 1438207 | * | 6/1976 | (GB) | 72/350 |

* cited by examiner

*Primary Examiner*—Lowell A. Larson
(74) *Attorney, Agent, or Firm*—Charles E. Leahy

(57) ABSTRACT

To hold the edges of a sheet metal blank during stamping or forming, such as stretch forming, a flange of the blank is clamped between faces of one of the dies and a binder which form a lockbead in the flange that restrains movement of the flange during the subsequent forming operation. A double V lockbead having three alternately angled sharp bends of near 90 degrees and one or two connecting bends totaling near 90 degrees provides improved locking performance, especially where the clamping surfaces of the die are sloped from horizontal. The legs or sides of the beads may have unequal lengths. The bend angles may be varied, in appropriate cases, within a reasonable range of from 75 to 120 degrees more or less as desired. Also, an additional angle or two, forming a third V could be used. The lockbead forming shapes are machined into the mating die and binder to form and retain the lockbead during the metal forming process.

11 Claims, 4 Drawing Sheets

DOUBLE VEE LOCKBEAD FOR SHEET METAL FORMING

TECHNICAL FIELD

This invention relates to lockbeads and to lockbead retaining and forming means for restraining the edges of sheet metal blanks against inward motion during forming of the blanks into stampings in a forming press.

BACKGROUND OF THE INVENTION

It is known in the art relating to press forming of a sheet metal blank into a stamping, in particular stretch forming processes, to provide a lockbead around edges of the blank to hold the blank edges against inward motion during forming of the blank in a press. A conventional lockbead comprises a trapezoidal or nearly rectangular protrusion of the blank material upward or downward from the associated flange or edge portion of the blank.

The bead is usually formed in the press by engagement of the blank by one of upper and lower dies in the press and an associated binder (also called a cushion ring or blank holder). These members have opposed blank holding surfaces for engaging opposite sides of the blank adjacent its edges or periphery in what may be called the outer flange area of the blank. One of the opposing die and binder members is provided with a protruding bead of rectangular, square or trapezoidal cross section lying generally parallel to the blank edge. The other of the members has formed therein a mating bead recess or slot into which the protruding bead of the first member extends when the blank holding surfaces of the members are forced against opposite sides of the blank. This forms a nearly square, rectangular or trapezoidal bead in the blank running along its edges and trapped in the mating beads of the associated die and binder members.

A conventional bead, formed by a square protrusion forcing the blank into a parallel sided slot with small clearance, forms a nearly square sided bead in the blank having four sequential bends in the bead of nearly 90 degrees each, but slightly less because of the clearance required for bead forming. In stretch forming of sheet metal blanks, for example, the bead is usually capable of restraining the blank edges against inward motion if the angles of the four bends total 340 degrees or more (for example 85 degrees for each bend). This works well for horizontally disposed blank edge flanges but is less or not at all satisfactory where the blank edges are disposed at an angle, such as 45 degrees from horizontal. In such a case, the requirement that the slot edges remain vertical for entry of the protruding bead during a vertical motion of the press causes the bends in the bead to be substantially less than 90 degrees. The resulting sum of the bends then falls to significantly less than 340 degrees and sometimes less than 300 degrees, resulting in inadequate restraint of the flanges, or blank edges, against slipping, or inward motion during forming.

SUMMARY OF THE INVENTION

The present invention provides a novel form of double V or similar form of lockbead and lockbead retaining and forming means. Lockbeads and their retaining means according to the invention provide restraint which is less dependent upon clamping surface angle and is able to provide 340 degrees or more of total bending while using less of the blank edge material than a conventional lockbead. In a preferred embodiment, the double V lockbead includes three alternately angled sharp bends forming in cross section the double V configuration. Two additional sharp bends of about 45 degrees each connect the double V bead with the adjacent portions of the clamped flange of the blank. The sum of the five angles thus totals at least 340 degrees, nearly 90 degrees each from the three bends of the double V and nearly 45 degrees each for the two connecting bends. Because of their shape and the possibility of using slightly shorter legs between the bends than with a conventional bead, the double V bead uses less material of the blank flanges for bead formation. Thus, a substantial saving of sheet metal is accomplished which provides cost savings for the double V bead as opposed to conventional beads.

In various alternative embodiments, the bend angles may vary and total more or less than 340 degrees as is required for the particular application, material and forces developed in the forming process being used. For example the sum of the alternately angled and connecting bends could be as little as 300 degrees with the alternately angled beads contributing only 225 degrees to the total. Each of the alternately angled bends could vary in a range of from 75 to 120 degrees. If desired, the double section could be increased by adding an additional bend, or two which would form a triple V bead. Then lesser bend angles might be adequate for forming loads or greater loads could be accommodated. In the unusual case of near vertical blank holding surfaces, the double V bead of this invention could still be used but one of the connecting bends would approach 90 degrees while the other side of the double V would have a nearly straight, connection. The legs or sides of the V elements may have unequal lengths but negative die angles or back draft cannot exist.

As to the lockbead retaining means or beads formed in one die and an associated binder, forming the bead surfaces with 90 degree angles would allow cutting the beads with a standard end mill. However, other bead surface angles can also be formed which could range from 105 to 60 degrees, comparable to the 75 to 120 degree bend angles mentioned above and considered reasonable for normal use. Other angles may, of course, be appropriate for various particular forming conditions.

These and other features and advantages of the invention will be more fully understood from the following description of certain specific embodiments of the invention taken together with the accompanying drawings.

DESCRIPTION OF THE PREFERRED EMBODIMENT

Figure 1:
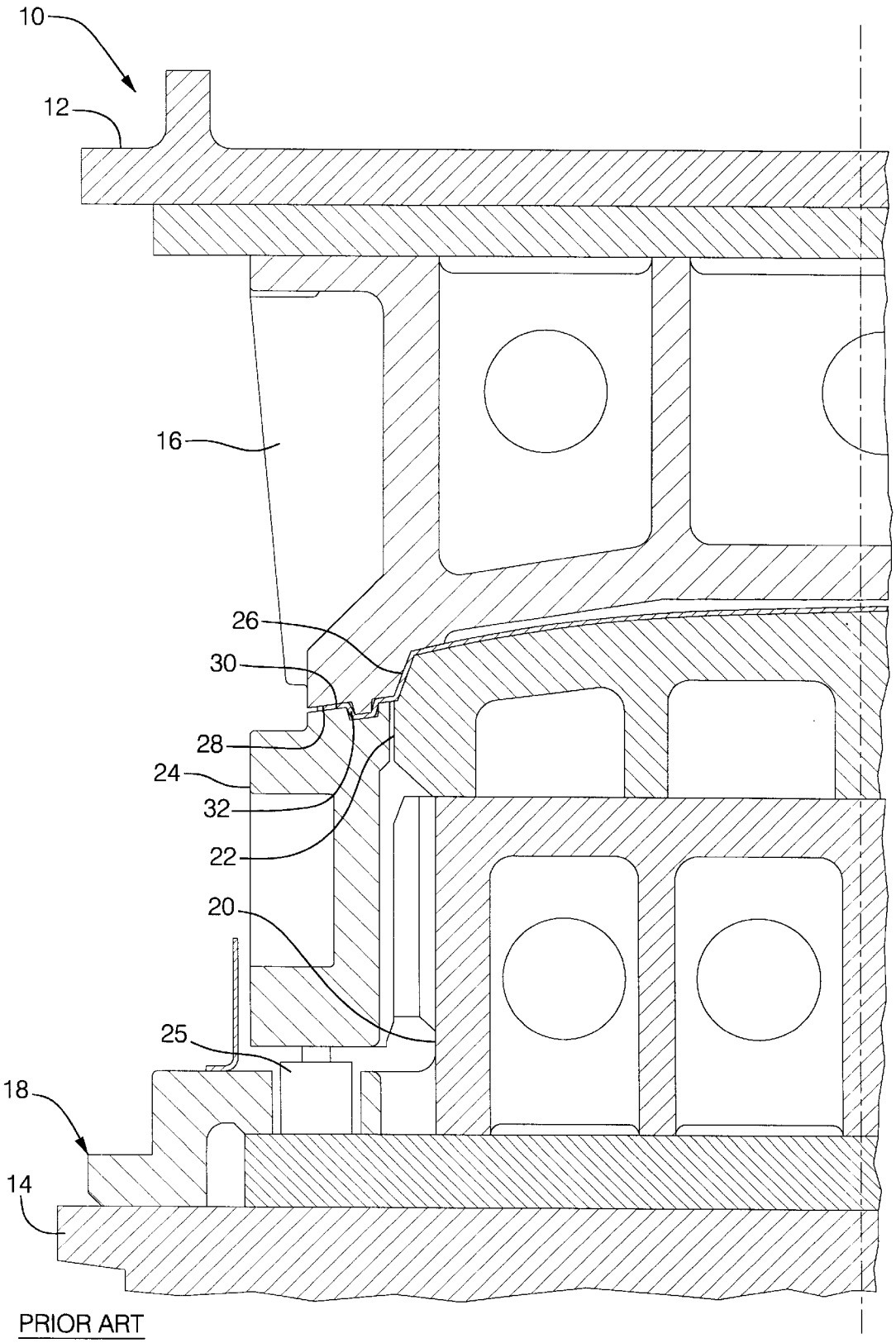
PRIOR ART FIG. 1
FIG. 1 is a fragmentary cross-sectional view of a single action forming press including dies and a binder ring with a lockbead illustrative of the prior art.

Referring first to FIG. 1 of the drawings in detail, numeral 10 generally indicates a single action forming press having a movable upper platen 12 and stationary lower platen 14. The upper platen 12 is vertically movable and is shown in its lower position. An upper die 16 is mounted to the upper platen 12.

The lower platen 14 mounts a lower die assembly 18 including a lower die shoe 20. A fixed lower punch cap 22 is carried on an upper surface of the lower die shoe 20. A movable cushion retainer ring or binder 24 surrounds the lower punch cap 22 and the upper portion of the lower die shoe 20. The binder 24 is supported on pneumatic cylinders 25 which are operable to move the binder vertically and provide a controlled resistance to downward motion thereof. A sheet metal blank formed into a stamping 26 is illustrated clamped between the upper die 16 on the upper side and the lower punch cap 22 and the surrounding binder 24 on the lower side of the blank. The stamping 26 is shown in its finish formed condition wherein the upper die has been fully lowered to form the blank by engagement of its upper and lower surfaces with corresponding lower and upper surfaces of the upper and lower dies.

Outward of the punch cap 22, the upper die 16 and the binder 24 below are provided with opposing clamping surfaces 28, 30, respectively. An outer edge portion or flange 32 of the sheet metal blank or stamping 26 is clamped between the surfaces 28, 30 and is locked against inward lateral motion by a lockbead to be described in connection with FIG. 2.

Figure 2:
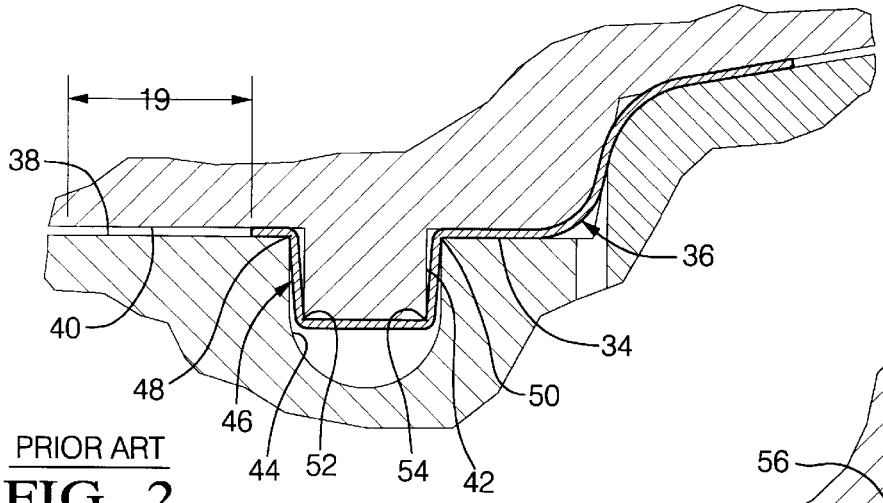
PRIOR ART FIG. 2
FIGS. 2 and 3 are schematic views showing prior art lockbeads applied to horizontal and angled clamping surfaces.

Referring now to FIG. 2, there is shown a flange 34 or outer edge portion of a sheet metal blank formed into a stamping 36. The flange 34 is clamped between an upwardly facing clamping surface 38 of a binder and a downwardly facing clamping surface 40 of an upper die. The clamping surface 40 includes a downwardly projecting bead 42 of square cross section extending into a straight sided groove 44 in the binder clamping surface 38. The flange 34 of stamping 36 is formed with a bead 46 having an approximately square cross section that follows the contours of the downwardly protruding bead 42. The cross-sectional configuration has sides which are not completely parallel by reason of a small clearance between the protrusion 42 and the groove 44 to allow for forming of the bead 46 without tearing of the blank. Preferably, the clearance is about equal to one sheet metal thickness on each side of the die bead 42.

The contours of the protruding bead 42 and groove 44 and the resulting bead 46 formed in the metal blank or stamping 36 represent conventional prior art construction previously used for restraining inward motion of the flanges or outer edges of blanks during their forming by various processes, such as stretch form stamping, in die presses of various types. In this embodiment, the inner and outer corners of the protrusion 42 are formed with 90 degree angles for ease of machining. The upper corners of the groove 44 are also formed with 90 degree angles. The resulting bead 46 in the sheet metal flange 34 has a slightly off square shape by reason of the small clearance provided between the protrusion 42 and groove 44 so that the bead 46 includes four bends including two outward bends 48, 50 and two inward bends 52, 54, each of which forms a bend angle of slightly less than 90 degrees for a total bend angle for the four bends of slightly less than 360 degrees.

It should be understood that the terms bend angle and bend refer to the angle (here slightly less than 90 degrees) through which the metal is bent at each of the respective bends as opposed to the included angles of the bent legs of the bead which form included angles of slightly greater than 90 degrees. Thus, in general, reference to the configuration of the sheet metal bead will be by bend angles whereas reference to the machined angles of protrusions and grooves in the corresponding die and binder members will be by reference to included angles of the machined surfaces.

Figure 3:
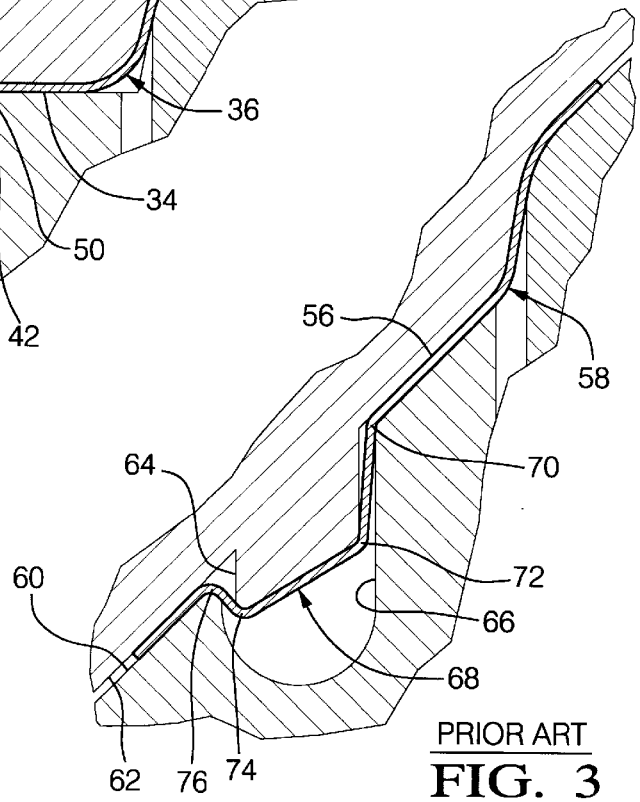
PRIOR ART FIG. 3

Referring now to FIG. 3 of the drawings, there is shown a modified form of prior art lockbead wherein a flange 56 of a sheet metal blank formed into a stamping 58 is clamped between an upper clamping surface 60 of a binder and an opposing lower clamping surface 62 of an upper die, surfaces 60 and 62 being oriented at approximately a 45 degree slope with respect to the horizontal. Again, the lower clamping surface 62 includes a downwardly protruding bead 64 having parallel vertical sides which cooperates and extends into a vertically sided groove 66 in the associated binder surface 60.

Bringing together of the surfaces 60, 62 against the flange 66 deforms the flange into a bead 68 which includes four bends 70, 72, 74, 76. Because of the angle of the clamping surfaces 60, 62, two of the bends form bend angles of less than 90 degrees at bends 70, 72, while the remaining bends 74, 76 are radiused to avoid metal tearing. The result is a less than satisfactory clamping restraint of the metal during the forming process since the total of the bend angles of the bead equals substantially less than a desirable 340 degrees.

It should be noted at this point in reference to FIG. 1, that the slightly sloped clamping surfaces 28, 30 of the die 16 and binder 24 shown there result in a less distorted form of prior art lockbead than that shown in FIG. 3. In FIG. 1, the protrusion from the upper die has a trapezoidal cross-sectional configuration capable of forming bend angles in the associated blank or stamping flange 32 approximating 85 degrees and therefore adequate to restrain the flange against inward motion during forming of the associated blank into a desirably configured stamping. However, as the slopes of clamping surfaces increase, as in FIG. 3, the prior lockbead configuration becomes inadequate.

Figure 4:
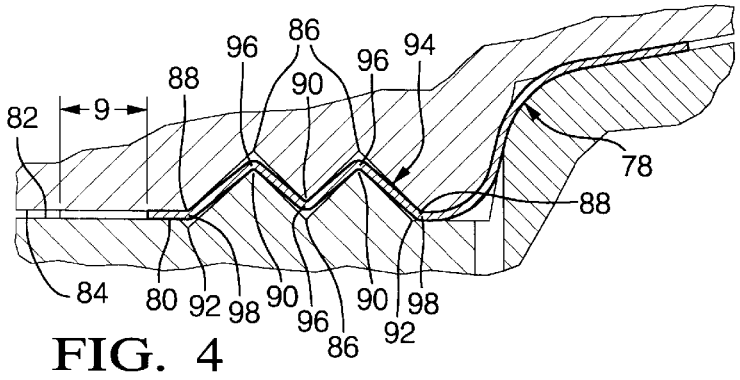
FIGS. 4 and 5 are schematic views showing upwardly and downwardly projecting lockbeads of the present invention applied to horizontal clamping surfaces.

Referring now to FIG. 4, there is shown a first embodiment of double V lockbead formed in accordance with the present invention. Here a sheet metal blank formed into a stamping 78 includes a flange 80 clamped between parallel upper and lower clamping surfaces 82, 84, respectively, of an associated binder and upper die respectively. The lower clamping surface 84 of the upper die is formed with double V recesses creating three alternating sharp angles 86 of preferably 90 degrees each and outwardly connected with the horizontal lower clamping surface 84 by connecting sharp angles 88 of 45 degrees each which together provide a total angular sum of 360 degrees. The opposing upper clamping surface 82 is formed with mating upward protrusions forming alternate sharp angles each of 90 degrees, the protrusions being connected with the upper clamping surface 82 by 45 degree angles 92.

When the flange 80 is compressed between these surfaces 82, 84, a double V bead 94 results which includes centrally three alternately angled bends 96 forming a double V configuration. These bends approximate but are slightly less than 90 degrees because of the clearance (about 0.5 mm) provided between the sheet metal and the angled surfaces to avoid the need for spotting or fitting of the machined die members. The double V bead is then connected by connecting bends 98 to the adjacent horizontal surfaces 82, 84, the connecting bends being approximately 45 degrees or slightly less. Again, the total of the bend angles is nearly 360 degrees, which has been shown to form more than an adequate restraint for the flanges or outer edges of blanks being formed in an associated die press. It should be noted that, because of the double V form as well as the shorter lengths of the legs of the double V bead, the bead 94 itself occupies or requires a smaller portion of the flange 80 to form the bead. For example, comparing the prior art embodiment of FIG. 2 with the inventive embodiment of FIG. 4, the width of the flange required for formation of the double V bead is less by 10 mm than that required for formation of the prior art square bead. Thus, a substantial saving of material is obtained by use of the improved double V bead.

Figure 5:
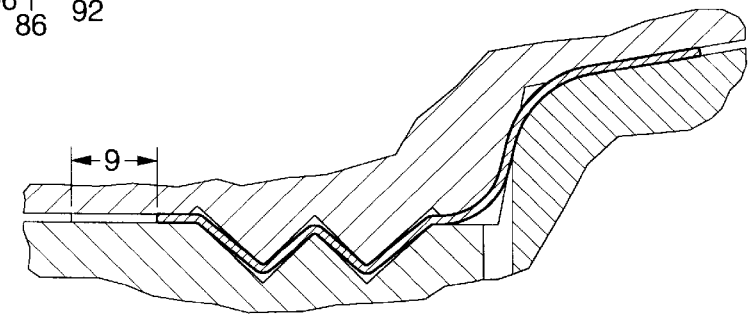

Referring now to FIG. 5, a double V bead arrangement similar to but reversed from that of FIG. 4 is illustrated. Without numerical references, it is merely noted that the double V recesses or grooves are formed in the binder while the mating double V protrusions are formed in the upper die with the corresponding dimensions of the angles and bends being the same as described in connection with FIG. 4. The operation and capabilities of the inverted bead of FIG. 5 are thus the same as those of the described bead of FIG. 4.

Figure 6:
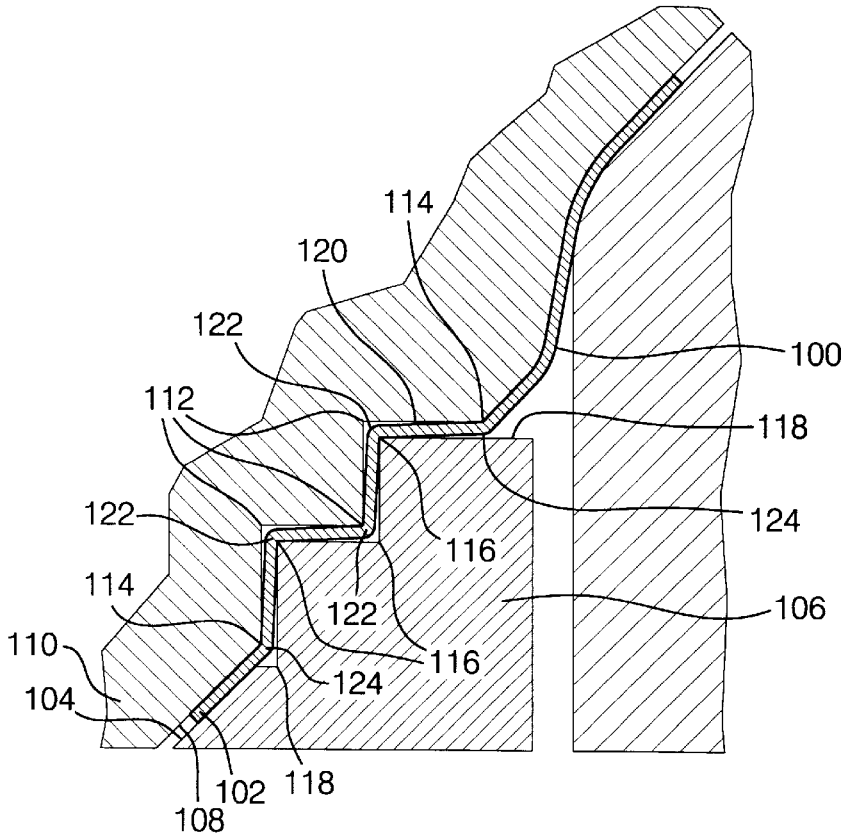
FIG. 6 is a cross-sectional view showing an upwardly projecting lockbead of the present invention applied to angled clamping surfaces.

Reference is now made to FIG. 6 wherein a double V bead application is disclosed which corresponds in general nature to the application of a prior art bead between sloping clamping surfaces as illustrated in FIG. 3. In FIG. 6, a sheet metal blank formed into a stamping 100 has a flange 102 formed at a 45 degree angle from the horizontal and clamped between a correspondingly sloping upper clamping surface 104 of an associated binder 106 and a lower clamping surface 108 of a mating upper die 110. The lower surface 108 is formed with three alternating sharp angles 112 of 90 degrees each, forming a double V recess connected with the sloping surface 108 by connecting 45 degree sharp angles 114. In like manner, the binder 106 includes dual protrusions having alternating 90 degree sharp angles 116 with connecting 45 degree angles 118. The sides of the angled portions extend alternately vertically and horizontally so that the vertically moving die may be engaged with the stationary or movement resisting binder 106. The resulting embossment 120 forms a double V bead having three alternately angled bends 122 of nearly 90 degrees connected at their edges by near 45 degree connecting bends 124. Thus, the sum of the sharp bend angles forming the bead is slightly less than 360 degrees and in excess of 340 degrees, as is considered desirable for restraining the blank. The double V bead according to the invention therefore provides significantly improved clamping abilities as compared to the modified prior art bead of FIG. 3.

It is noted here that should there be a need in an unusual case to form a clamping surface which is more highly sloped, a double V bead of the sort described in FIG. 6 may still be utilized. However, as the slope approaches vertical, the upper connecting bend 124 will be increased while the lower connecting bend 124 will be decreased. The legs or sides of the V beads may have unequal lengths but negative die angles or back draft must be avoided. In this case, however, the total of the alternating and connecting bends will still approximate 360 degrees or slightly less, so that the total clamping ability is not diminished by the increased slope of the clamping surfaces.

Figure 7:
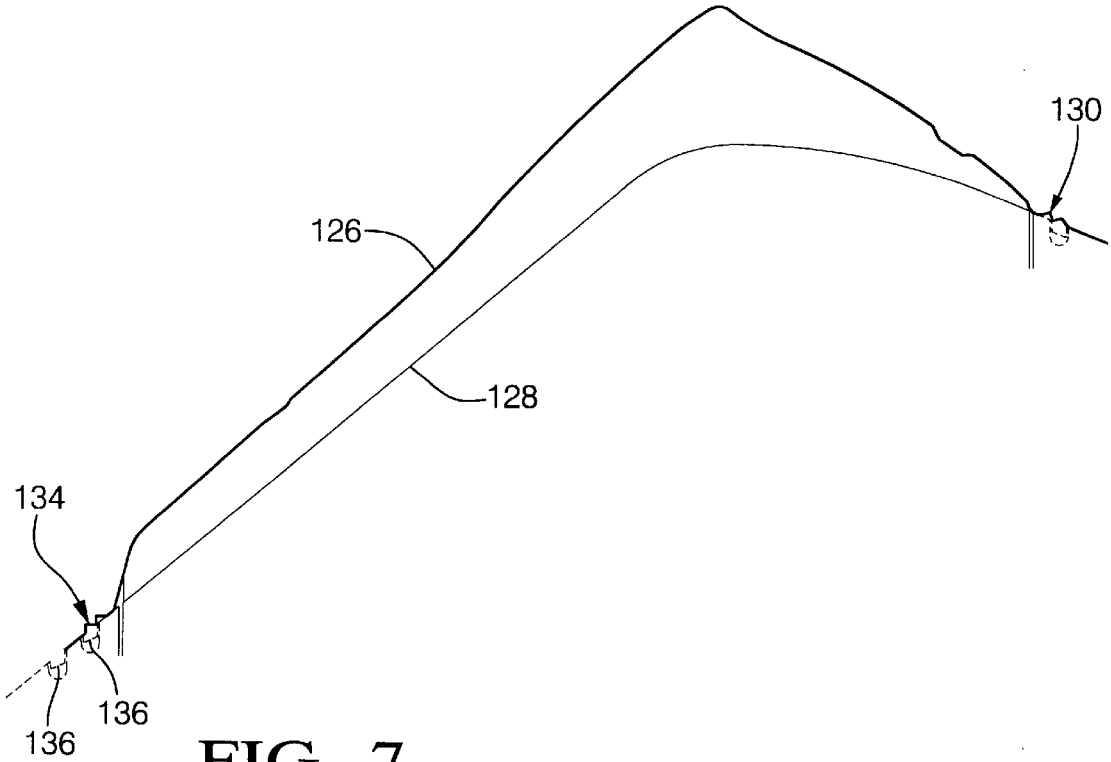
FIGS. 7–9 are line drawings comparing the application of the present invention and prior art lockbeads to forming of a compartment lid panel.
Figure 8:
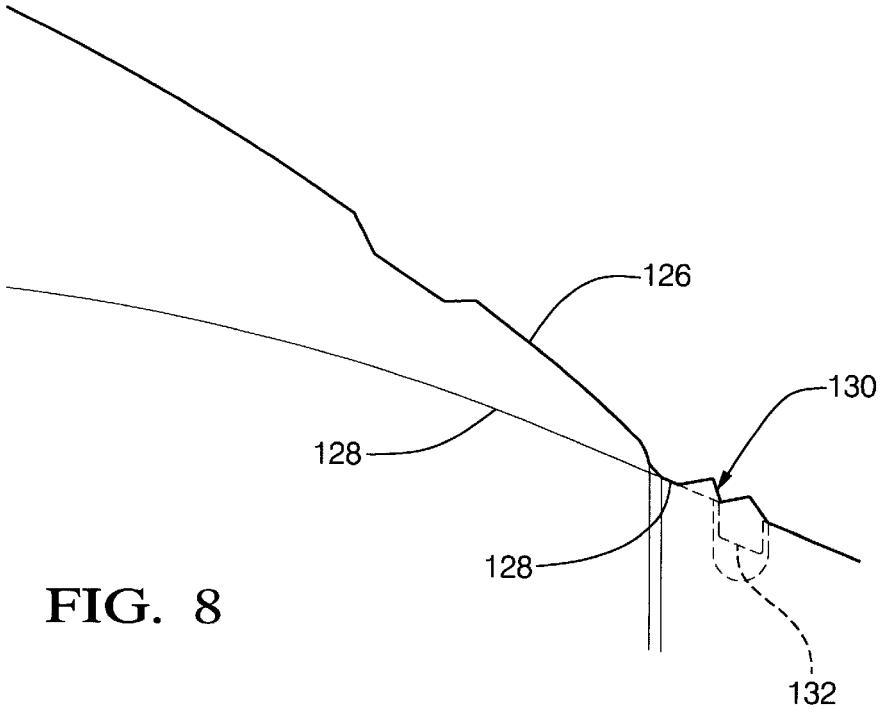
Figure 9:
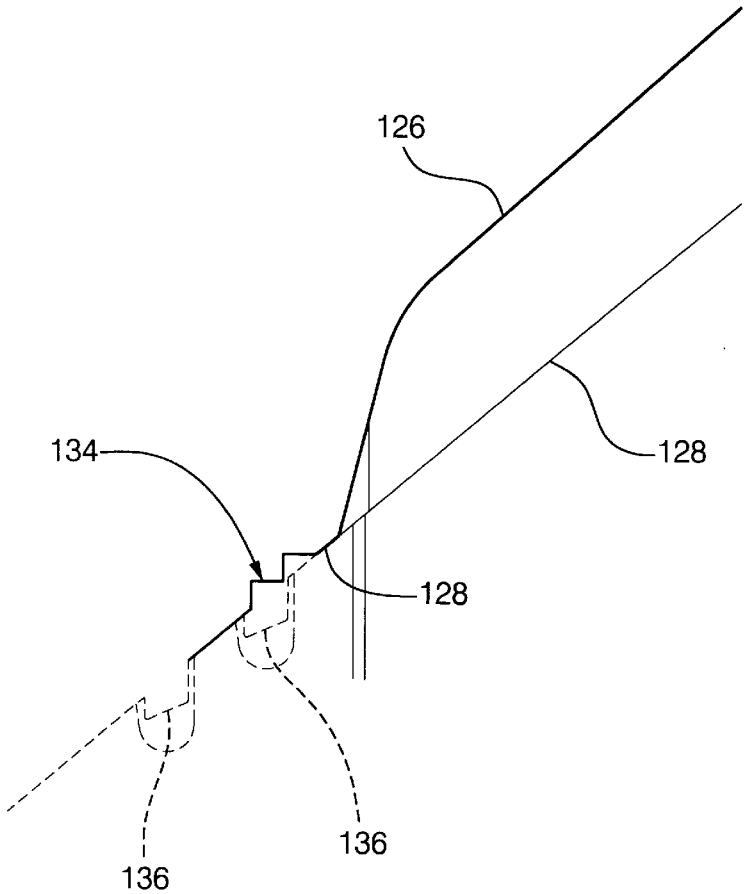

Referring now to FIGS. 7–9, there is shown in schematic form the application of the present invention as compared to prior art restraining beads to the forming of a compartment lid outer panel, indicated by numeral 126. Panel 126 is provided with a flange 128 which has a multi-directional orientation extending from a relatively smaller slope at the right end of FIG. 7, also shown in FIG 8, and a relatively steeper slope of about 45 degrees at the left end of FIG. 7, also shown in FIG. 9. At its right end, which forms the lower rear edge of the trunk lid, as shown in FIGS. 7 and 8, the flange is restrained by a double V bead 130, replacing the modified prior art bead 132 which has somewhat less restraining force. On its left end, as shown in FIG. 7 and in FIG. 9, a double V bead 134, formed according to the invention, replaces a pair of prior art beads 136, which would be required to provide a restraining force equal to that of the double V bead on the relatively highly sloped surface of the flange 128.

As should be apparent, a novel double V bead arrangement has been presented which provides increased flange restraining force under various conditions of flange orientation from horizontal to near vertical in place of a prior art bead shown to be inadequate for use with flange clamping surface orientations beyond 30 degrees from horizontal. It should be noted that modifications of the double V bead could involve variations in the bend angles of the bead within reasonable ranges appropriate to the particular application and might also include the addition of one or more alternately angled bends which, in the case of two additional bends, would form a triple V bead that adds one additional V to the double V bead arrangement disclosed. The legs or sides of the beads may have unequal lengths which enhance the die machining process or prevent prohibitive negative draft angle.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A lockbead for restraining edges of a sheet metal blank against inward motion during forming of the blank into a stamping in a forming press, said lockbead comprising:

an embossment of the blank extending generally in a direction normal to the direction of metal flow of the blank during forming, said embossment having in cross section first, second and third alternately angled sharp edged bends defining a straight sided double V configuration having a connecting sharp edged bend at at least one of inner and outer edges connecting the double V configuration with adjacent portions of the blank.

2. A lockbead as in claim 1 wherein the sum of said alternately angled and connecting bends equals at least 300 degrees.

3. A lockbead as in claim 2 wherein the sum of said alternately angled bends equals at least 225 degrees.

4. A lockbead as in claim 3 wherein each of said alternately angled bends falls in a range of from 75 to 120 degrees.

5. A lockbead as in claim 4 wherein said alternately angled bends are approximately equal and individually approximate 90 degrees.

6. A lockbead as in claim 4 wherein the sum of said alternately angled and connecting bends falls in a range of from 340 to 360 degrees.

7. A lockbead as in claim 1 wherein said alternately angled edged bends include at least one additional edged bend between the double V configuration and an adjacent portion of the blank.

8. Lockbead retainers formed on opposite blank holding surfaces of blank restraining members for use in a sheet metal forming press, said lockbead retainers comprising mating bead surfaces defining, when engaging opposite sides of a sheet metal blank, a gap having in cross section first, second and third alternate sharp edged angles defining a straight sided double V configuration having a connecting sharp edged angle at at least one of inner and outer edges connecting the double V configuration with adjacent portions of the blank holding surfaces.

9. Lockbead retainers as in claim 8 wherein said alternate sharp angles each fall in a range of from 60 to 105 degrees.

10. Lockbead retainers as in claim 9 wherein said alternate sharp angles are equal.

11. Lockbead retainers as in claim 10 wherein said alternate sharp angles are each essentially 90 degrees.

* * * * *